US009829838B2

(12) United States Patent
Harashima

(10) Patent No.: US 9,829,838 B2
(45) Date of Patent: Nov. 28, 2017

(54) IMAGE FORMING APPARATUS

(71) Applicant: FUJI XEROX CO., LTD., Tokyo (JP)

(72) Inventor: Yasumitsu Harashima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/246,617

(22) Filed: Aug. 25, 2016

(65) Prior Publication Data

US 2017/0248883 A1 Aug. 31, 2017

(30) Foreign Application Priority Data

Feb. 25, 2016 (JP) ..... 2016-034679

(51) Int. Cl.
*G03G 15/20* (2006.01)

(52) U.S. Cl.
CPC ..... *G03G 15/2039* (2013.01); *G03G 15/2078* (2013.01)

(58) Field of Classification Search
CPC ..... G03G 15/2039; G03G 15/2078
See application file for complete search history.

(56) References Cited

U.S. PATENT DOCUMENTS 6,885,830 B2 4/2005 Hirota et al.
9,008,529 B2 * 4/2015 Kiuchi ..... G03G 15/2046 399/67
2004/0037573 A1 2/2004 Hirota et al.

FOREIGN PATENT DOCUMENTS

JP 2004-077931 A 3/2004
JP 2005-196078 A 7/2005
JP 2007-286100 A 11/2007
JP 2012-242752 A 12/2012
JP 2017-003614 A 1/2017

OTHER PUBLICATIONS

Communication dated Apr. 18, 2017, issued from the Japan Patent Office in counterpart Japanese Application No. 2016-034679.
Communication dated Jul. 18, 2017 from the Japanese Patent Office in counterpart application No. 2016-034679.

* cited by examiner

*Primary Examiner* — Hoang Ngo
(74) *Attorney, Agent, or Firm* — Sughrue Mion, PLLC

(57) ABSTRACT

An image forming apparatus fixes a toner image, in which plural layers constituted from toners with different low-temperature storage elastic moduli as measured in the temperature range of 30° C. or more and 50° C. or less are superposed on each other, to a medium. The image forming apparatus changes the fixing temperature in accordance with the order of superposition of the plural layers.

1 Claim, 10 Drawing Sheets

FIG. 8

| FORM | FIXING TEMPERATURE FOR LAYER CONFIGURATION (°C) | | | EVALUATION RESULT FOR LAYER CONFIGURATION | | | | | | COMPREHENSIVE EVALUATION RESULT |
|---|---|---|---|---|---|---|---|---|---|---|
| | LAYER CONFIGURATION 1 | LAYER CONFIGURATION 2 | LAYER CONFIGURATION 3 | LAYER CONFIGURATION 1 | | LAYER CONFIGURATION 2 | | LAYER CONFIGURATION 3 | | |
| | | | | IMAGE QUALITY EVALUATION | PEEL EVALUATION | IMAGE QUALITY EVALUATION | PEEL EVALUATION | IMAGE QUALITY EVALUATION | PEEL EVALUATION | |
| EXEMPLARY EMBODIMENT | 160 | 155 | 150 | GOOD | GOOD | GOOD | GOOD | GOOD | GOOD | PASSING |
| FIRST COMPARATIVE FORM | 160 | 160 | 160 | GOOD | GOOD | POOR | GOOD | POOR | GOOD | FAILING |
| SECOND COMPARATIVE FORM | 155 | 155 | 155 | GOOD | POOR | GOOD | GOOD | POOR | GOOD | FAILING |
| THIRD COMPARATIVE FORM | 150 | 150 | 150 | GOOD | POOR | GOOD | POOR | GOOD | GOOD | FAILING |

IMAGE FORMING APPARATUS

CROSS-REFERENCE TO RELATED APPLICATIONS

This application is based on and claims priority under 35 USC 119 from Japanese Patent Application No. 2016-034679 filed Feb. 25, 2016.

BACKGROUND

Technical Field

The present invention relates to an image forming apparatus.

SUMMARY

According to an aspect of the present invention, there is provided an image forming apparatus that fixes a toner image, in which plural layers constituted from toners with different low-temperature storage elastic moduli as measured in a temperature range of 30° C. or more and 50° C. or less are superposed on each other, to a medium, and that changes a fixing temperature in accordance with an order of superposition of the plural layers.

BRIEF DESCRIPTION OF THE DRAWINGS

An exemplary embodiment of the present invention will be described in detail based on the following figures, wherein:

FIG. 8 is a table indicating the evaluation result for a case where a toner image with each layer configuration is fixed to a medium in the exemplary embodiment and the comparative forms;

DETAILED DESCRIPTION

Overview

Figure 1A:
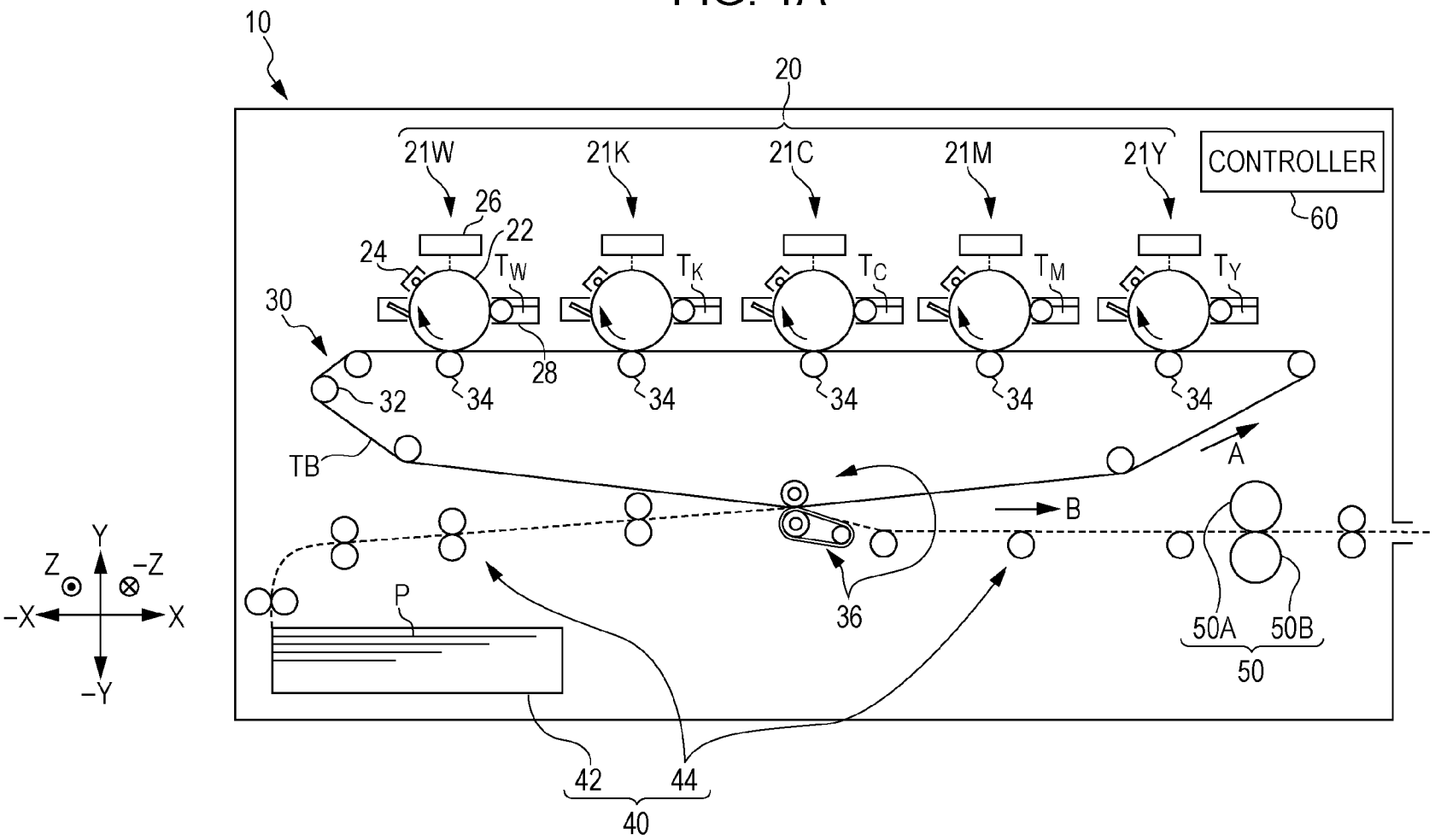
FIG. 1A is a schematic diagram (front view) of an image forming apparatus according to an exemplary embodiment for a case where the order of arrangement of single-color units is a first arrangement example.

An exemplary embodiment will be described below. First, the configuration of an image forming apparatus 10 (see FIGS. 1A, 1B, and 1C) according to the exemplary embodiment will be described. Then, image forming operation of the image forming apparatus 10 according to the exemplary embodiment will be described.

In the following description, the direction indicated by the arrow X and the arrow −X in the drawings is defined as the apparatus width direction, and the direction indicated by the arrow Y and the arrow −Y in the drawings is defined as the apparatus height direction. In addition, the direction orthogonal to the apparatus width direction and the apparatus height direction (the direction indicated by the arrow Z and the arrow −Z) is defined as the apparatus depth direction.

<Configuration of Image Forming Apparatus>

The configuration of the image forming apparatus 10 will be described below with reference to FIGS. 1A, 1B, and 1C. The image forming apparatus 10 is an electrophotographic device that includes a toner image forming section 20, a transfer device 30, a transport device 40, a fixing device 50, and a controller 60.

[Toner Image Forming Section]

Figure 4:
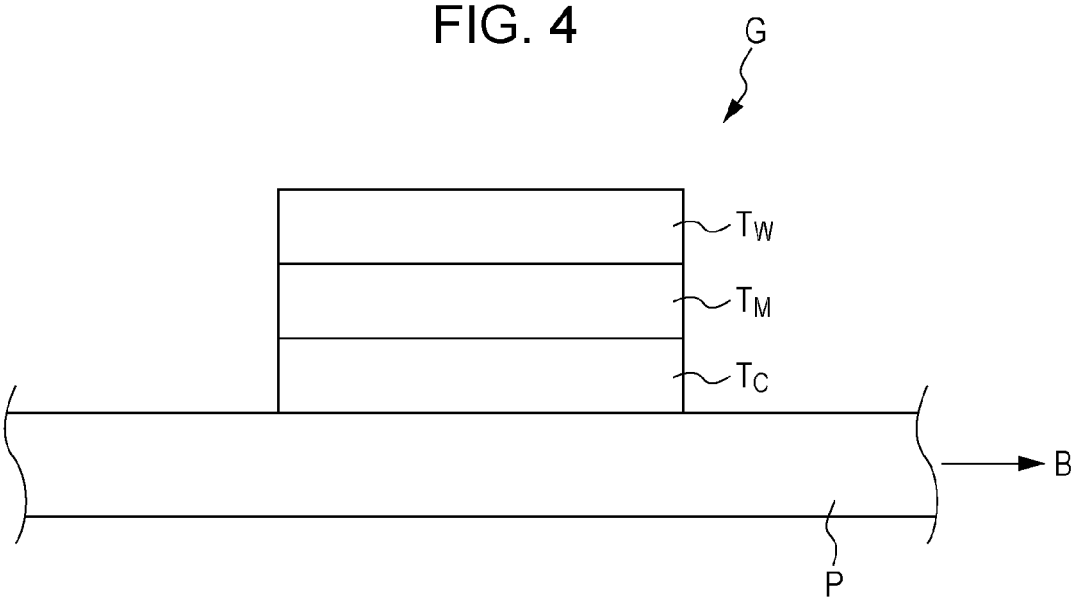
FIG. 4 is a schematic diagram illustrating an example of a toner image (a three-layer toner image constituted with a layer configuration 2) transferred to a medium using a second mode in the exemplary embodiment.
Figure 5:
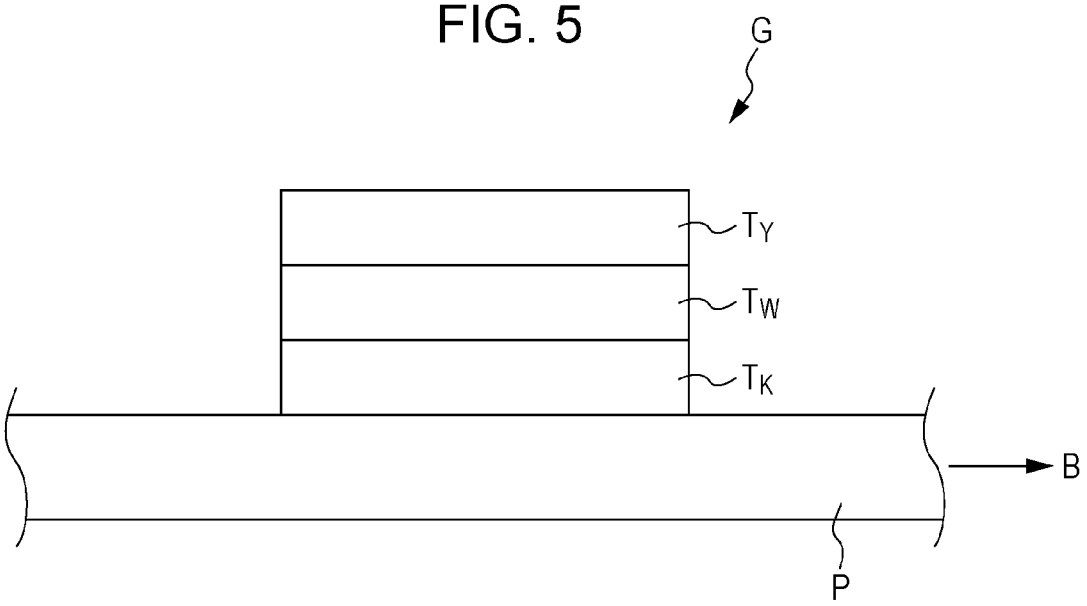
FIG. 5 is a schematic diagram illustrating an example of a toner image (a three-layer toner image constituted with a layer configuration 3) transferred to a medium using a third mode in the exemplary embodiment.

The toner image forming section 20 has a function of performing charging, exposing, and developing processes to form a toner image G (see FIGS. 3, 4, and 5) on a transfer belt TB to be discussed later that constitutes the transfer device 30.

By way of example, the toner image forming section 20 is composed of single-color units 21Y, 21M, 21C, 21K, and 21W that form the toner image G in different colors (yellow (Y), magenta (M), cyan (C), black (K), and white (W), respectively), on respective photoconductors 22 to be discussed later. The single-color units 21Y, 21M, 21C, 21K, and 21W are constructed in the same manner as each other except that they use different toners $T_Y$, $T_M$, $T_C$, $T_K$, and $T_W$, respectively. In the following description, alphabets (Y, M, C, K, and W) for the single-color units 21Y, 21M, 21C, 21K, and 21W and the toners $T_Y$, $T_M$, $T_C$, $T_K$, and $T_W$ will be omitted unless it is necessary to differentiate the single-color units 21Y, 21M, 21C, 21K, and 21W and constituent elements thereof from each other.

Each of the single-color units 21 includes a cylindrical photoconductor 22, a charging device 24, an exposure device 26, and a developing device 28. The charging device 24 charges the photoconductor 22. The exposure device 26 exposes the photoconductor 22 to light (forms a latent image on the photoconductor 22). The developing device 28 develops the toner image G. The symbols for the constituent elements of the single-color units 21 are omitted in the drawings except for the single-color unit 21W.

Figure 2:
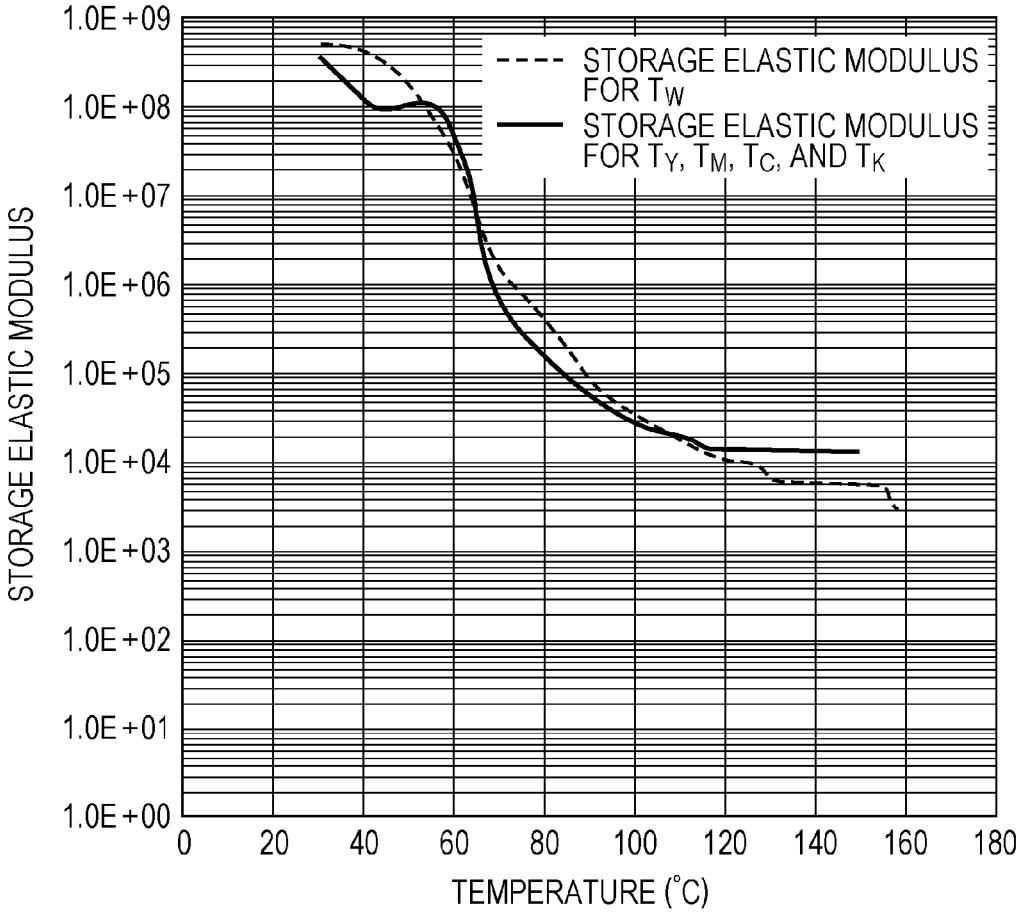
FIG. 2 is a graph indicating the specific storage elastic modulus with respect to the temperature for a toner in each color used in the image forming apparatus according to the exemplary embodiment.

By way of example, the low-temperature storage elastic moduli (hereinafter referred to as "specific storage elastic moduli") of the toners T (toners $T_Y$, $T_M$, $T_C$, and $T_K$) other than the toner $T_W$ as measured in the temperature range of 30° C. or more and 50° C. or less are the same as each other. In contrast, as illustrated in FIG. 2, the specific storage elastic modulus of the toner $T_W$ is higher than the specific storage elastic moduli of the toners T (toners $T_Y$, $T_M$, $T_C$, and TO other than the toner $T_W$. The specific storage elastic modulus refers to a low-temperature storage elastic modulus as measured in the temperature range of 30° C. or more and 50° C. or less. The storage elastic modulus is measured using a rheometer (ARES) manufactured by TA Instruments. Specifically, the storage elastic modulus is measured with a sample (toner) set to a sample holder with a diameter of 8 mm, and at a temperature rising rate of 1° C./min, at a frequency of 1 Hz, with a distortion of 1% or less, and with detected torque within the range of measurement guarantee values. Variations in storage elastic modulus with respect to temperature variations are obtained. An analysis is performed using the standard software for the viscoelasticity measuring instrument. The low-temperature storage elastic modulus, which is the storage elastic modulus measured in the temperature range of 30° C. or more and 50° C. or less, is calculated as the average value of the low-temperature storage elastic moduli obtained at each degree of temperature in the temperature range of 30° C. or more and 50° C. or less. The language "the low-temperature storage elastic modulus is high or low" means that the average value is large or small.

The toner T is more difficult to be melted (difficult to be fixed) by heating as the specific storage elastic modulus is higher. From the above, in the case of the exemplary embodiment, the toner $T_W$ is more difficult to be melted (difficult to be fixed) than the toners T other than the toner $T_W$. By way of example, the appropriate fixing temperature for a case where the toner image G which is constituted from the toner $T_W$ is directly fixed to a medium P is 160° C. Meanwhile, by way of example, the appropriate fixing temperature for a case where the toner image G which is constituted from any of the toners T (toners $T_Y$, $T_M$, $T_C$, and $T_K$) other than the toner $T_W$ is directly fixed to the medium P is 155° C.

The constituent elements of each of the single-color units 21 excluding the exposure device 26 are integrally removable from (attachable to) the body of the image forming apparatus 10. Hereinafter, the constituent elements of each of the single-color units 21 excluding the exposure device 26 will be referred to as "constituents". The image forming apparatus 10 of FIG. 1A is an example (hereinafter, "first arrangement example") in which the single-color units 21Y, 21M, 21C, 21K, and 21W are arranged in the order in which they are mentioned from the X side to the −X side along the apparatus width direction. The image forming apparatus 10 of FIG. 1B is an example ("second arrangement example") in which the single-color units 21W, 21Y, 21M, 21C, and 21K are arranged in the order in which they are mentioned from the X side to the −X side along the apparatus width direction. The image forming apparatus 10 of FIG. 1C is an example ("third arrangement example") in which the single-color units 21Y, 21M, 21W, 21C, and 21K are arranged in the order in which they are mentioned from the X side to the −X side along the apparatus width direction. Each of the constituents has a storage device (not illustrated) that stores information on its own toner color. Once each of the constituents is attached to the body of the image forming apparatus 10, information on the position of each of the constituents (order of arrangement of the single-color units 21) is stored in the storage device (not illustrated) of the controller 60. The technical meaning of storing information on the toner color of each of the single-color units 21 is to store information on the specific storage elastic modulus of the toner T of each of the single-color units 21.

[Transfer Device]

The transfer device 30 has a function of performing a first transfer of the toner image G in each color formed on the photoconductor 22 of each single-color unit 21 to the belt TB to be discussed later to perform a second transfer to the medium P transported by the transport device 40. The transfer device 30 includes the belt TB, a drive roller 32, plural first transfer rollers 34, and a second transfer unit 36. The belt TB is an endless belt, and is wound around the drive roller 32 to be circulated in the direction of the arrow A. Each of the first transfer rollers 34 holds the belt TB and forms a nip on the belt TB with the photoconductor 22 of each of the single-color units 21, and performs a first transfer of the toner image G in each color formed on each of the photoconductors 22 to the belt TB. The second transfer unit 36 forms a nip on the belt TB across the belt TB, and performs a second transfer of the toner image G, which has been subjected to the first transfer, to the medium P transported to the nip by the transport device 40. The toner image G which is constituted from the toner images G in various colors, which have been transferred from the photoconductors 22 through the first transfer, includes a toner image G in which layers constituted from the toners T in different colors are superposed on each other.

[Transport Device]

The transport device 40 has a function of transporting the medium P. The transport device 40 includes plural housing sections 42 and plural transfer rollers 44. The plural housing sections 42 house different types of the medium P in accordance with the type. Specifically, in the case of the exemplary embodiment, by way of example, one of the housing sections 42 houses sheets of regular paper of A4 size, and another housing section 42 houses transparent films of A4 size. The plural transfer rollers 44 send the medium P housed in each of the housing sections 42 to a transport passage (indicated by the broken line in the drawings) to transport the medium P along the transport passage. The direction of the arrow B in the drawings indicates the direction of transport of the medium P by the transport device 40. The type of the medium P housed in each of the housing sections 42 is input by a user through an interface (not illustrated) of the image forming apparatus 10 to be stored in the storage device (not illustrated) of the controller 60.

[Fixing Device]

The fixing device 50 has a function of heating and pressurizing the medium P, to which the toner image G has been transferred through the second transfer by the transfer device 30 and which has been transported by the transport device 40, to fix the toner image G to the medium P. For example, in the case where the toner image G, in which layers constituted from the toners T in different colors are superposed on each other, has been transferred to the medium P through the second transfer, the fixing device 50 fixes the toner image G to the medium P. The fixing device 50 includes a heating section 50A and a pressurizing section 50B. By way of example, the heating section 50A and the pressurizing section 50B according to the exemplary embodiment are each provided as a roller.

[Controller]

The controller 60 has a function of controlling the various components of the image forming apparatus 10 other than the controller 60. The typical functions of the controller 60 according to the exemplary embodiment include the following functions.

As discussed earlier, the controller 60 stores, in its storage device, the order of arrangement of the single-color units 21. In the case where the toner image G in which a layer constituted from the toner $T_W$ and a layer constituted from the toners T other than the toner $T_W$ are superposed on each other is to be formed, for example, the image forming apparatus 10 with the first arrangement example (see FIG. 1A) is able to form only the toner image G (see FIG. 3) in which the layer constituted from the toner $T_W$ is the closest to the medium P. Therefore, in the case where image data for the toner image G (see FIGS. 4 and 5) which may not be formed by the image forming apparatus 10 with the first arrangement example are received from an external device (not illustrated), the controller 60 indicates that an image may not be formed using the external device, by way of example. Meanwhile, in the case where the toner image G in which a layer constituted from the toner $T_W$ and a layer constituted from the toners T other than the toner $T_W$ are superposed on each other is to be formed, for example, the image forming apparatus 10 with the second arrangement example (see FIG. 1B) is able to form only the toner image G (see FIG. 4) in which the layer constituted from the toner $T_W$ is the farthest from the medium P. Therefore, in the case where image data for the toner image G (see FIGS. 3 and 5) which may not be formed by the image forming apparatus 10 with the second arrangement example are received from an external device (not illustrated), the controller 60 indicates that an image may not be formed using the external device, by way of example.

In addition, the controller 60 changes the fixing temperature (which refers to the temperature of the outer periphery of the roller which constitutes the heating section 50A of the fixing device 50) in the case where the toner image G is fixed to the medium P using the fixing device 50. Specifically, the controller 60 changes the fixing temperature in accordance with the order of superposition of plural layers in the case where the toner image G is fixed to the medium P. In this case, the controller 60 changes the fixing temperature such that the fixing temperature for a case where the toner $T_W$ constitutes a layer that is the closest to the medium P is higher than the fixing temperature for a case where the toner $T_W$ constitutes a layer other than the layer that is the closest to the medium P. The layer configuration for a case where the toner $T_W$ constitutes a layer that is the closest to the medium P corresponds to a layer configuration 1 (see FIG. 3) to be discussed later, by way of example. The fixing temperature for this case is 160° C. (see FIG. 6), by way of example. Meanwhile, the layer configuration for a case where the toner $T_W$ constitutes a layer other than the layer that is the closest to the medium P corresponds to a layer configuration 2 (see FIG. 4) and a layer configuration 3 (see FIG. 5) to be discussed later, by way of example. The fixing temperatures for these cases are 155° C. and 150° C. (see FIG. 6), respectively, by way of example.

Although an example of the function of the controller 60 has been described above, the function of the controller 60 will be described in detail in the description of the image forming operation of the image forming apparatus 10.

The configuration of the image forming apparatus 10 according to the exemplary embodiment has been described above.

<Image Forming Operation>

Next, the image forming operation will be described with reference to FIGS. 1A, 1B, and 1C. First, the image forming operation performed by the image forming apparatus 10 using the toners T other than the toner $T_W$ will be described. Then, the image forming operation performed by the image forming apparatus 10 using the toners T including the toner $T_W$ will be described. The "image forming operation performed using the toners T other than the toner $T_W$" means image forming operation performed without using the toner $T_W$, specifically image forming operation performed using at least one or more of the toners $T_Y$, $T_M$, $T_C$, and $T_K$.

[Image Forming Operation Performed Using Toners T Other than Toner $T_W$]

The controller 60 which has received image data from an external device (not illustrated) causes the various components of the image forming apparatus 10 other than the controller 60 to operate. The image data include data on the type of the medium P to be used in the image forming operation and the toner image G to be fixed to the medium P.

First, the toner image G in each color (in the case of a single color, the toner image G in the single color) is formed on each photoconductor 22 by each single-color unit 21 of the toner image forming section 20. The toner image G formed on each photoconductor 22 is transferred to the belt TB by the transfer device 30 through the first transfer, and thereafter transferred to the medium P transferred to the transport device 40 through the second transfer. Then, the medium P to which the toner image G has been transferred through the second transfer is transported toward the fixing device 50 by the transport device 40 so that the toner image G is fixed to the medium P by the fixing device 50 (an image is formed on the medium P). The medium P, on which an image has been formed, is discharged to the outside of the image forming apparatus 10 by the transport device 40 to finish the image forming operation. In the case of the image forming operation performed using the toners T other than the toner $T_W$, the controller 60 causes the fixing device 50 to perform fixing operation with the fixing temperature, at which fixing is performed by the fixing device 50, set to 155° C., by way of example.

[Image Forming Operation Performed Using Toners T Including Toner $T_W$]

First, the controller 60 determines, from the image data received from the external device (not illustrated), which of the layer configurations (layer configurations 1, 2, and 3) the layer configuration of the toner image G to be fixed to the medium P belongs to. Then, the controller 60 determines, from the information on the order of arrangement of the single-color units 21 stored in the storage device (not illustrated) of the controller 60, whether the layer configuration of the toner image G may be formed with the current order of arrangement of the single-color units 21. If it is determined that the layer configuration of the toner image G may be formed with the current order of arrangement of the single-color units 21, the controller 60 controls the various components other than the controller 60 so as to perform image forming operation on the basis of the image data. If it is not determined that the layer configuration of the toner image G may be formed with the current order of arrangement of the single-color units 21, the controller 60 indicates that image formation may not be performed using an external device, by way of example, in order not to cause the various components other than the controller 60 to perform image forming operation.

Figure 3:
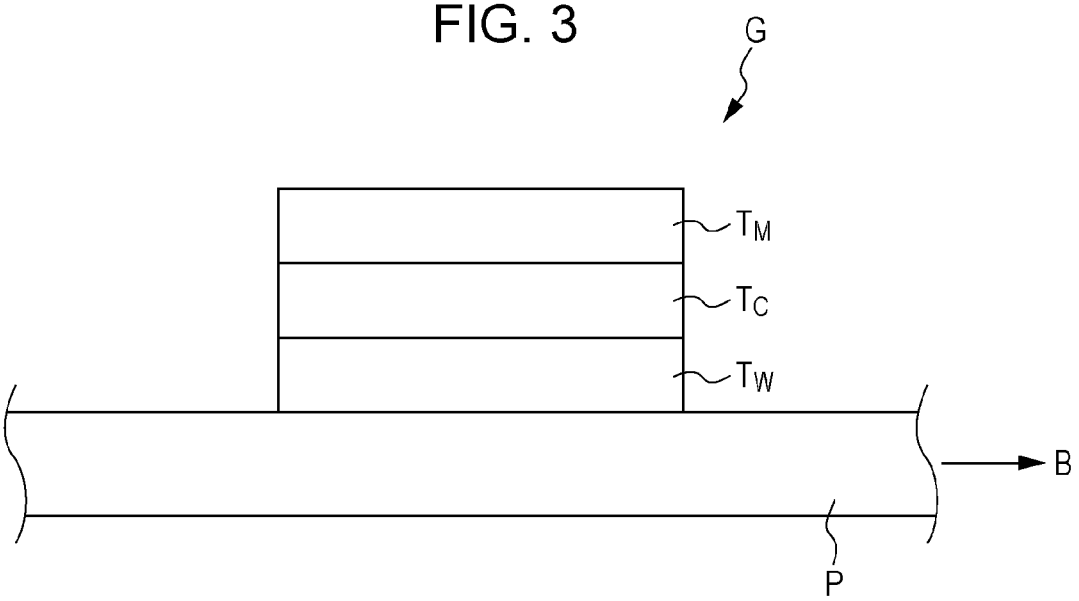
FIG. 3 is a schematic diagram illustrating an example of a toner image (a three-layer toner image constituted with a layer configuration 1) transferred to a medium using a first mode in the exemplary embodiment.

The "layer configuration 1" refers to a layer configuration in which the toner image G with two or more layers superposed on each other is to be fixed to the medium P and a layer constituted from the toner $T_W$ constitutes the layer that is the closest to the medium P (the layer configuration of FIG. 3, for example). Examples of the layer configuration 1 include the toner image G constituted from only the toner $T_W$, that is, the toner image G in which the layer configuration includes a single layer. From the above, the layer configuration 1 is considered to be a layer configuration in which the layer constituted from the toner $T_W$ directly contacts the medium P. The "layer configuration 2" refers to a layer configuration in which the toner image G with two or more layers superposed on each other is to be fixed to the medium P and a layer constituted from the toner $T_W$ constitutes the layer that is the farthest from the medium P (the layer configuration of FIG. 4, for example). The "layer configuration 3" refers to a layer configuration in which the toner image G with three or more layers superposed on each other is to be fixed to the medium P and a layer constituted from the toner $T_W$ constitutes a layer other than the layer that is the closest to the medium P and the layer that is the farthest from the medium P (the layer configuration of FIG. 5, for example).

Fixing the toner image G with the layer configuration 1 to the medium P includes fixing, in the case of the first arrangement example (see FIG. 1A), the toner image G, in which layers constituted from the toners T in the various colors are superposed on each other, to a transparent film using the single-color units 21M, 21C, and 21W, for example. Hereinafter, such a case will be referred to as "first mode". In the case of the first mode, an image formed on the transparent film is visually recognized from the side of the transparent film to which the toner image G has been fixed. Fixing the toner image G with the layer configuration 2 to the medium P includes fixing, in the case of the second arrangement example (see FIG. 1B), the toner image G, in which layers constituted from the toners T in the various colors are superposed on each other, to a transparent film using the single-color units 21W, 21M, and 21C, for example. Hereinafter, such a case will be referred to as "second mode". In the case of the second mode, an image formed on the transparent film is visually recognized from the side opposite to the side of the transparent film to which the toner image G has been fixed. Fixing the toner image G with the layer configuration 3 to the medium P includes fixing, in the case of the third arrangement example (see FIG. 1C), the toner image G, in which layers constituted from the toners T in the various colors are superposed on each other, to a transparent film using the single-color units 21Y, 21W, and 21K, for example. Hereinafter, such a case will be referred to as "third mode". In the case of the third mode, an image formed on the transparent film is visually recognized from both sides of the transparent film.

Figure 6:
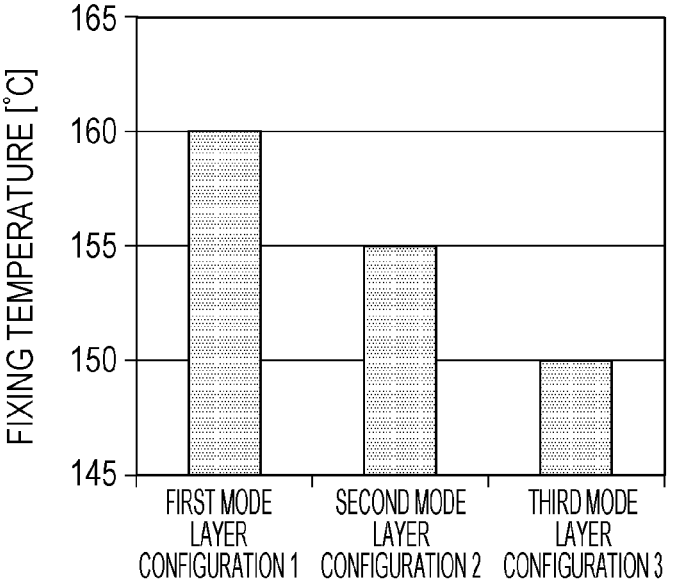
FIG. 6 is a graph indicating the fixing temperature in the first, second, and third modes in the exemplary embodiment.

Then, in the case where the controller 60 controls the various components other than the controller 60 so as to perform image forming operation on the basis of the image data, the controller 60 controls the various components other than the controller 60 in the same manner as in the image forming operation performed using the toners T other than the toner $T_W$ discussed earlier. In this case, as illustrated in FIG. 6, the controller 60 causes the fixing device 50 to perform the fixing operation with the fixing temperature set to 160° C. in the case of the first mode, 155° C. in the case of the second mode, and 150° C. in the case of the third mode, by way of example. That is, the controller 60 causes the fixing device 50 to perform the fixing operation with the fixing temperature for the first mode set to be higher than the fixing temperatures for the second mode and the third mode. The transparent film, on which an image has been formed, is discharged to the outside of the image forming apparatus 10 by the transport device 40 to finish the image forming operation.

The image forming operation according to the exemplary embodiment has been described above.

The evaluation result obtained by performing an evaluation test to be discussed later on the exemplary embodiment and comparative forms (first to third comparative forms) to be discussed later will be described. In the case where components that are the same as those used in the exemplary embodiment are used in the comparative forms, the same reference symbols are used for the components even if such reference symbols are not used in the drawings.

[Evaluation Test]

In the evaluation test, the image forming apparatus 10 according to the exemplary embodiment and image forming apparatuses according to the comparative forms (first to third comparative forms) are used to fix the toner image G with each of the layer configurations (layer configurations 1, 2, and 3) to a transparent film to obtain three types of samples for each exemplary embodiment or form. The three types of samples obtained from each exemplary embodiment or form are subjected to an image quality evaluation and a peel evaluation to make a comprehensive evaluation on each exemplary embodiment or form. In the image quality evaluation and the peel evaluation for each sample, an evaluation is made as to whether the sample is good or poor. In the comprehensive evaluation for each exemplary embodiment or form, the exemplary embodiment or form is determined to be passing if all the samples are evaluated as good in the image quality evaluation and the peel evaluation, and determined to be failing if any of the samples is evaluated as poor in the image quality evaluation or the peel evaluation.

In the image quality evaluation, an image of the sample is visually observed for image spots. The sample is evaluated to be good in the case where no image spots are found when the obtained sample image is visually checked, and evaluated to be poor in the case where image spots are found when the obtained sample image is visually checked. In the case where the sample is evaluated to be poor in the image quality evaluation, it is considered that there is a problem (fixing failure) with the image quality.

In the peel evaluation, meanwhile, the difference in thickness in color between the obtained sample image and an image obtained by applying an adhesive tape (product name "Scotch Mending Tape" (manufactured by Sumitomo 3M)) to the sample image and peeling the tape from the sample image is measured. The sample image is evaluated to be good in the case where the difference in thickness is smaller than a prescribed difference, and evaluated to be poor in the case where the difference in thickness is not smaller than the prescribed difference. The thickness is measured using a spectrophotometer 938 Spectro Densitometer (X-Rite). In the case where the sample image is evaluated to be poor in the peel evaluation, it is considered that there is a problem (fixation failure) with the fixing strength of the toner image G fixed to the transparent film.

[Configuration of Comparative Forms]

Figure 7A:
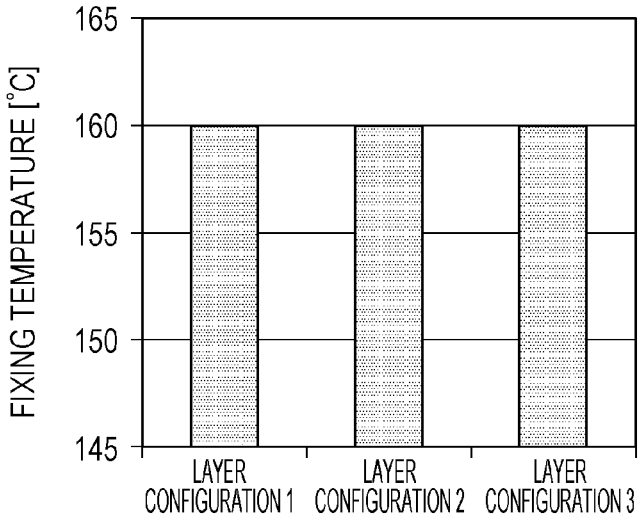
FIG. 7A is a graph indicating the fixing temperature for a case where the toner images constituted with the layer configurations 1, 2, and 3 are fixed to a medium in a first comparative form.
Figure 7B:
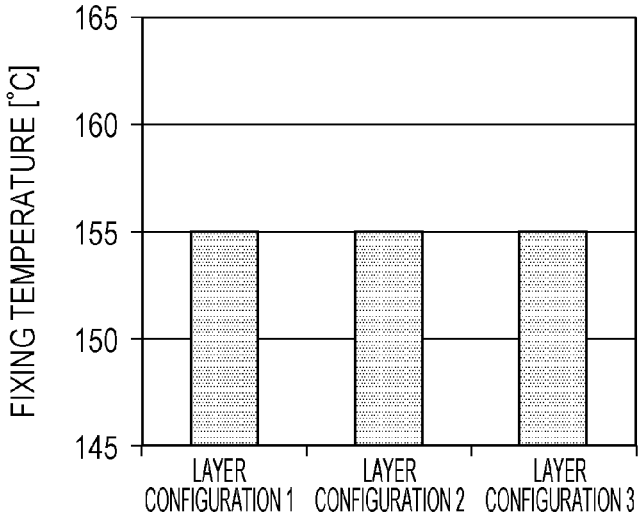
FIG. 7B is a graph indicating the fixing temperature for a case where the toner images constituted with the layer configurations 1, 2, and 3 are fixed to a medium in a second comparative form.
Figure 7C:
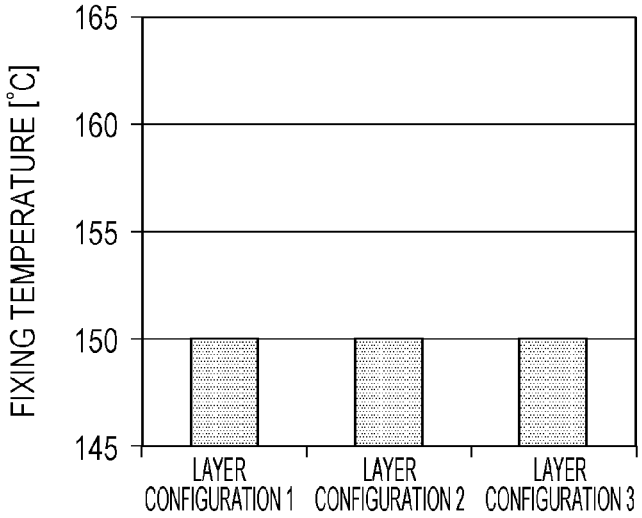
FIG. 7C is a graph indicating the fixing temperature for a case where the toner images constituted with the layer configurations 1, 2, and 3 are fixed to a medium in a third comparative form.

Next, the comparative forms will be described with reference to the drawings. As illustrated in FIGS. 7A, 7B, and 7C, the image forming apparatus (not illustrated) according to each comparative form does not change the fixing temperature whichever of the layer configurations (layer configurations 1, 2, and 3) the toner image G to be fixed may have. That is, the image forming apparatuses of all the comparative forms do not change the fixing temperature in accordance with the order of superposition of the plural layers constituting the toner image G. Specifically, the controller 60 according to the first comparative form causes the fixing device 50 to perform fixing operation with the fixing temperature set to 160° C. whichever of the layer configurations the toner image to be fixed may have. The controller 60 according to the second comparative form causes the fixing device 50 to perform fixing operation with the fixing temperature set to 155° C. whichever of the layer configurations the toner image to be fixed may have. The controller 60 according to the third comparative form causes the fixing device 50 to perform fixing operation with the fixing temperature set to 150° C. whichever of the layer configurations the toner image to be fixed may have. The comparative forms are otherwise similar in configuration to the exemplary embodiment.

[Result of Evaluation and Consideration]

Next, the evaluation result and the consideration for each form will be described with reference to the table of FIG. 8. Each comparative form will be described first, and the exemplary embodiment will then be described.

[Comparative Forms]

As a result of the comprehensive evaluation, all of the comparative forms are failing.

In the case of the first comparative form, the evaluation results of both the image quality evaluation and the peel evaluation for the sample with the layer configuration 1 are good. For the samples with the layer configurations 2 and 3, however, image spots are found in the image quality evaluation, and therefore the evaluation result of the image quality evaluation is poor. These results are considered to be because the fixing temperature for fixing the toner images G with the layer configurations 2 and 3 is too high (the toner images G are overheated).

In the case of the second comparative form, the evaluation results of both the image quality evaluation and the peel evaluation for the sample with the layer configuration 2 are good. For the sample with the layer configuration 1, however, the difference in thickness in color is more than a predetermined difference in the peel evaluation, and therefore the evaluation result of the peel evaluation is poor. These results are considered to be because the fixing temperature for fixing the toner image G with the layer configuration 1 is too low (the toner image G is not sufficiently heated). For the sample with the layer configuration 3, meanwhile, image spots are found in the image quality evaluation, and therefore the evaluation result of the image quality evaluation is poor. These results are considered to be because the fixing temperature for fixing the toner image G with the layer configuration 3 is too high (the toner image G is overheated).

In the case of the third comparative form, the evaluation results of both the image quality evaluation and the peel evaluation for the sample with the layer configuration 3 are good. For the samples with the layer configurations 1 and 2, however, the difference in thickness in color is more than a predetermined difference in the peel evaluation, and therefore the evaluation result of the peel evaluation is poor. These results are considered to be because the fixing temperature for fixing the toner images G with the layer configurations 1 and 3 is too low (the toner images G are not sufficiently heated).

Exemplary Embodiment

In the case of the exemplary embodiment, in contrast to the evaluation result for each comparative form described above, as indicated in the table of FIG. 8, the evaluation results of both the image quality evaluation and the peel evaluation for the layer configurations (layer configurations 1, 2, and 3) are good. That is, the comprehensive evaluation result is passing. The reason that the comprehensive evaluation result is passing in the case of the exemplary embodiment as described above is considered to be because the fixing temperature for fixing the toner image G with each layer configuration to a transparent film is set to an appropriate fixing temperature for each toner image G.

CONCLUSION

With the image forming apparatus 10 according to the exemplary embodiment, as has been described above, a fixing failure is suppressed in the case where the toner image G in which plural layers constituted from the toners T with different specific storage elastic moduli are superposed on each other, irrespective of the order of superposition, compared to an image forming apparatus in which the fixing temperature is not changed in accordance with the order of superposition of the plural layers constituting the toner image G. From a different point of view, with the image forming apparatus 10 according to the exemplary embodiment, a fixation failure is suppressed, irrespective of the order of superposition of the plural layers, compared to an image forming apparatus in which the fixing temperature is not changed whichever of the layers is constituted by the toner $T_W$, which is one of the toners T that has the highest specific storage elastic modulus.

In the case of the image forming apparatus 10 according to the exemplary embodiment, the fixing temperature is changed in accordance with the order of superposition of the plural layers constituting the toner image G. Specifically, with the image forming apparatus 10 according to the exemplary embodiment, the fixing temperature for fixing the toner images G with the layer configuration 2 and the layer configuration 3 and for fixing the toner image G formed using the toners T other than the toner $T_W$ is lowered compared to the fixing temperature for fixing the toner image G with the layer configuration 1. Therefore, with the image forming apparatus 10 according to the exemplary embodiment, the fixing temperature for normal image forming operation (for fixing the toner image G formed using the toners T other than the toner $T_W$) may be lowered (low power consumption) compared to the image forming apparatus according to the first comparative form, for example.

Although a specific exemplary embodiment of the present invention has been described above, the present invention is not limited to the exemplary embodiment discussed earlier. The technical scope of the present invention also includes the following forms, for example.

Figure 1B:
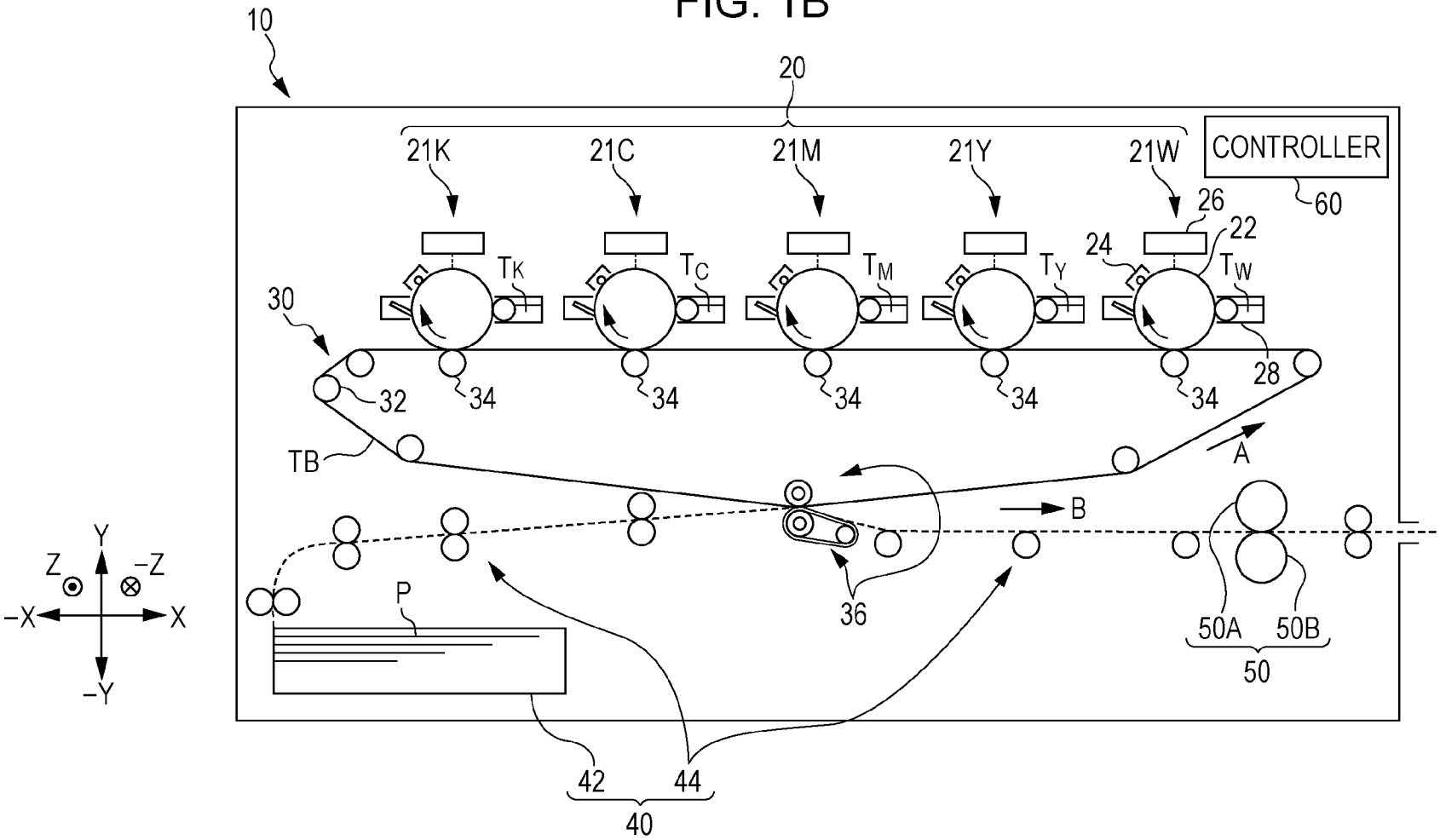
FIG. 1B is a schematic diagram (front view) of the image forming apparatus according to the exemplary embodiment for a case where the order of arrangement of the single-color units is a second arrangement example.
Figure 1C:
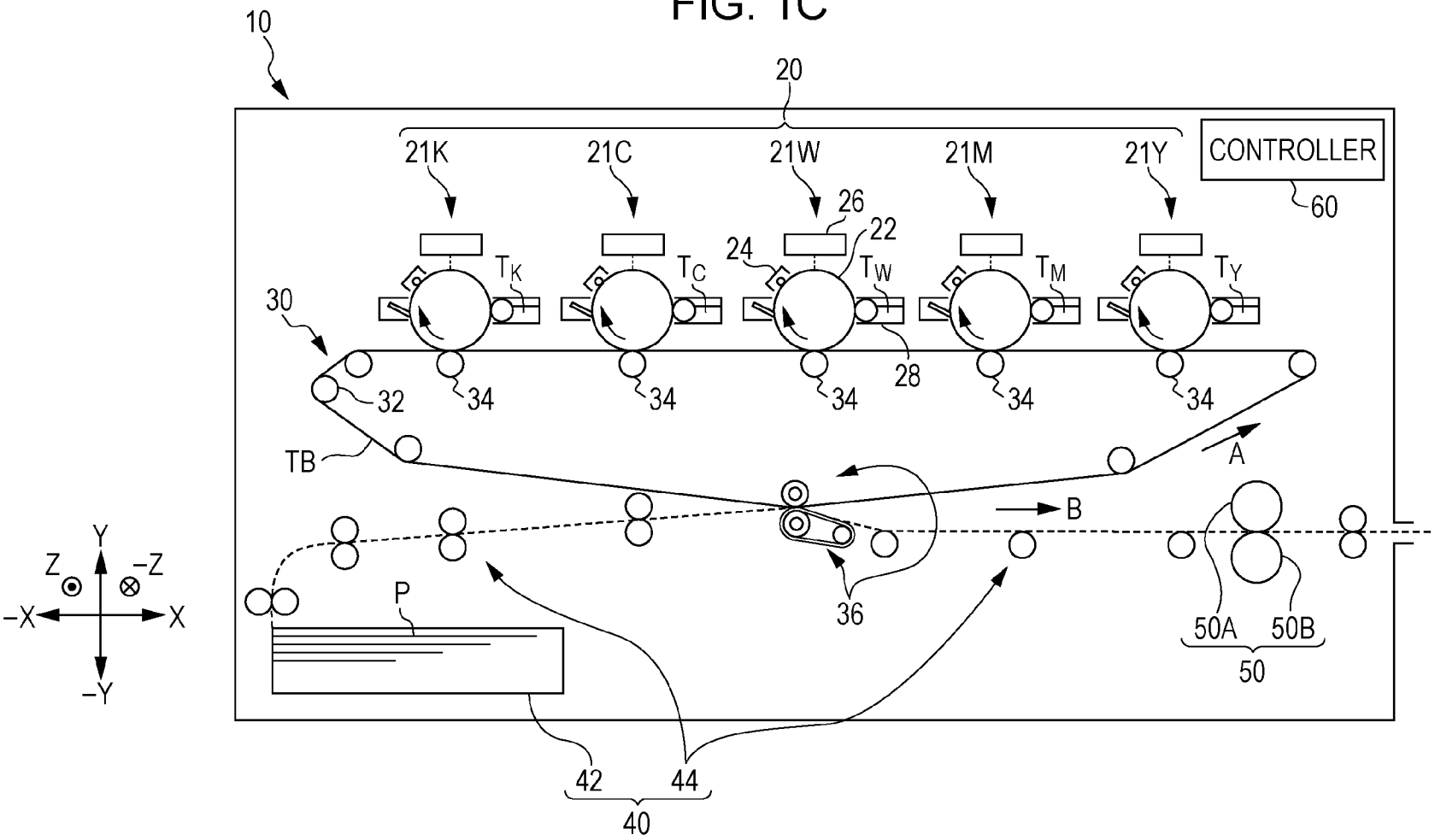
FIG. 1C is a schematic diagram (front view) of the image forming apparatus according to the exemplary embodiment for a case where the order of arrangement of the single-color units is a third arrangement example.

The image forming apparatus 10 according to the exemplary embodiment has been described as including five single-color units 21 that are rearrangeable as illustrated in FIGS. 1A, 1B, and 1C. However, the configuration of the image forming apparatus may be different from the configuration of the image forming apparatus 10 according to the exemplary embodiment as long as the toner image G in which plural layers constituted from the toners T with different specific storage elastic moduli are superposed on each other may be fixed to the medium P. For example, an image forming apparatus (not illustrated) according to a modification may be configured such that six single-color units 12W, 21Y, 21M, 21C, 21K, and 21W are arranged in the order in which they are mentioned from the X side to the −X side along the apparatus width direction. With this image forming apparatus, the toner images G with the layer configuration 1 (see FIG. 3) and the layer configuration 2 (see FIG. 4) may be formed without changing the order of arrangement of the single-color units 21. An image forming apparatus (not illustrated) according to another modification may include a developing device of a so-called rotary system. With this image forming apparatus, the toner images G with the layer configuration 1 (see FIG. 3), the layer configuration 2 (see FIG. 4), and the layer configuration 3 (see FIG. 5) may be formed by changing the order of development of the toner images G in each color.

Figure 9A:
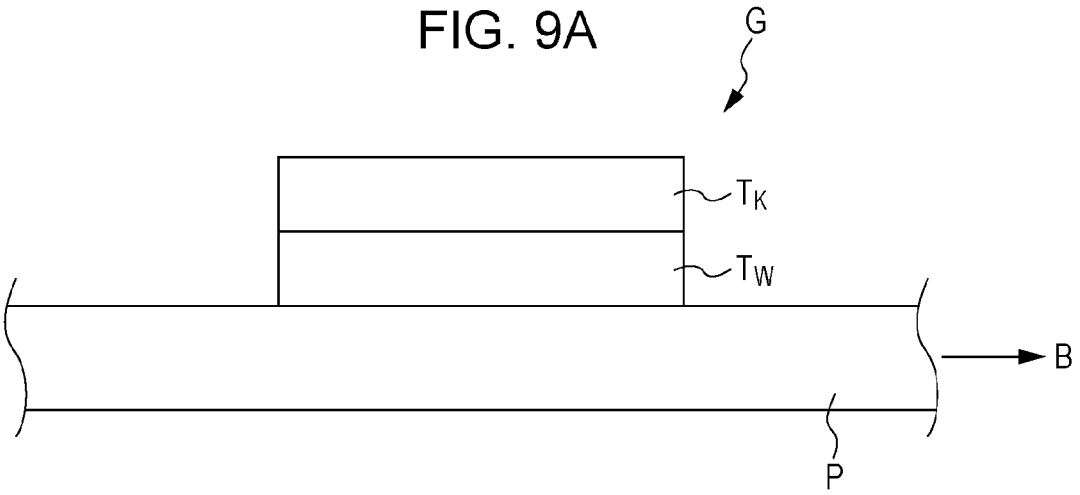
FIG. 9A is a schematic diagram illustrating an example of a toner image (a two-layer toner image constituted with a layer configuration 1) transferred to a medium using a first mode in a modification.
Figure 9B:
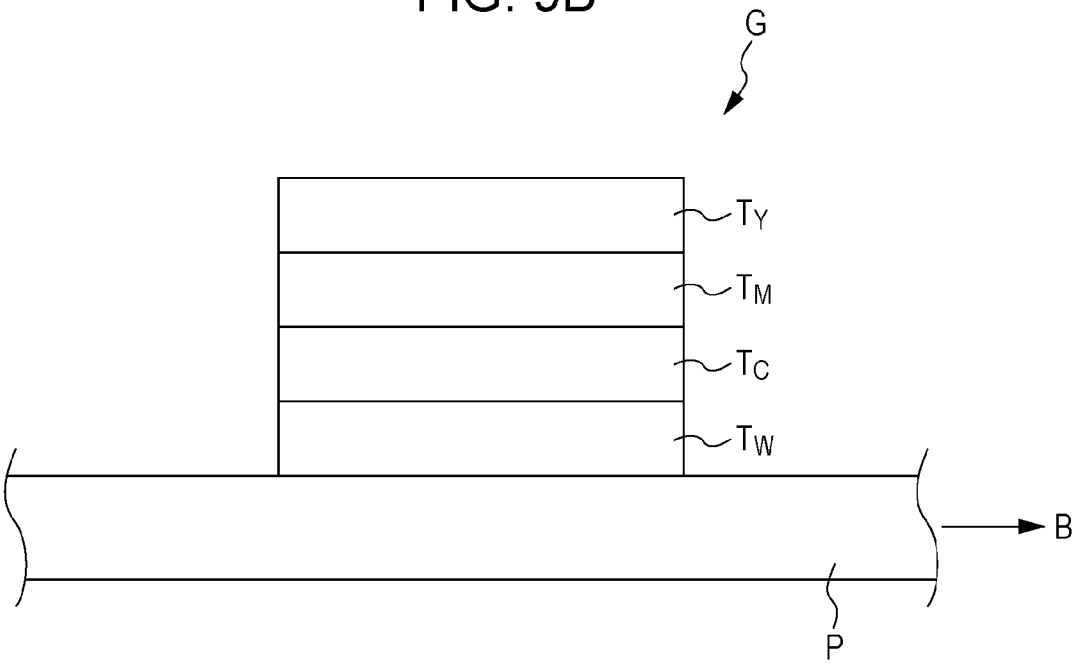
FIG. 9B is a schematic diagram illustrating an example of a toner image (a four-layer toner image constituted with a layer configuration 1) transferred to a medium using a first mode in a modification.
Figure 10A:
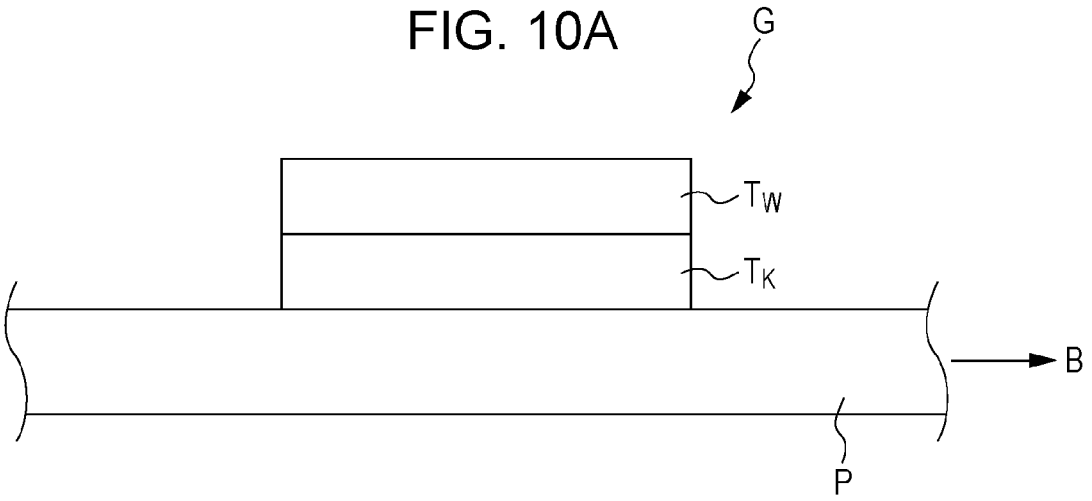
FIG. 10A is a schematic diagram illustrating an example of a toner image (a two-layer toner image constituted with a layer configuration 2) transferred to a medium using a second mode in a modification.
Figure 10B:
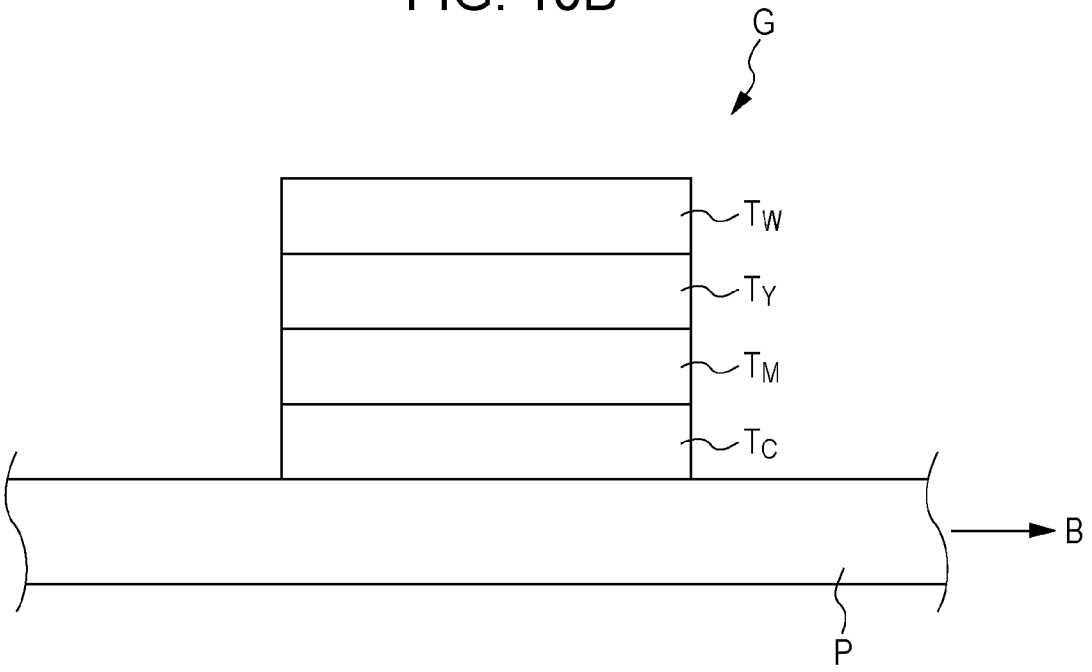
FIG. 10B is a schematic diagram illustrating an example of a toner image (a four-layer toner image constituted with a layer configuration 2) transferred to a medium using a second mode in a modification.

In the description of the exemplary embodiment, the layer configuration of FIG. 3 has been described as an example of the layer configuration 1. However, the layer configuration 1 is not limited to the layer configuration of FIG. 3 as long as the layer constituted from the toner T with the highest specific storage elastic modulus constitutes the layer that is the closest to the medium P in the layer configuration 1. For example, the layer configuration 1 may have a layer configuration such as those in FIG. 9A (an example with two layers) and FIG. 9B (an example with four layers). In the description of the exemplary embodiment, in addition, the layer configuration of FIG. 4 has been described as an example of the layer configuration 2. However, the layer configuration 2 is not limited to the layer configuration of FIG. 4 as long as two or more layers are superposed on each other and the layer constituted from the toner T with the highest specific storage elastic modulus constitutes the layer that is the farthest from the medium P in the layer configuration 2. For example, the layer configuration 2 may have a layer configuration such as those in FIG. 10A (an example with two layers) and FIG. 10B (an example with four layers).

The colors of the toners T in the exemplary embodiment have been described as yellow (Y), magenta (M), cyan (C), black (K), and white (W). However, the colors of the toners T may be in a different combination from that according to the exemplary embodiment as long as the plural layers constituted from the toners T are plural layers constituted from the toners T with different specific storage elastic moduli and superposed on each other. For example, a clear (CL) toner may be used in place of the white (W) toner. In addition, a toner in a metallic color such as gold and silver may be used in place of the white (W) toner.

In the exemplary embodiment, the toners $T_Y$, $T_M$, $T_C$, and $T_K$ have the same specific storage elastic modulus, and the specific storage elastic modulus of the toner $T_W$ is larger than the specific storage elastic modulus of the toners T other than the toner $T_W$. However, the relationship of the magnitude of the specific storage elastic moduli of the toners T may be different from that according to the exemplary embodiment if the controller 60 changes the fixing temperature in accordance with the order of superposition of the plural layers, specifically the controller 60 changes the fixing temperature such that the fixing temperature for a case where one of the toners T that has the highest specific storage elastic modulus constitutes the layer that is the closest to the medium P is higher than the fixing temperature for a case where the one of the toners T that has the highest specific storage elastic modulus constitutes a layer other than the layer that is the closest to the medium P. That is, in the case where the single-color units 21 are constituted from four single-color units 21Y, 21M, 21C, and 21K and the specific storage elastic modulus of the toner $T_Y$ is higher than the specific storage elastic moduli of the toners $T_M$, $T_C$, and $T_K$, the fixing temperature may be changed in accordance with the position of superposition of the layer constituted from the toner $T_Y$ in the plural layers.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus that fixes a toner image, in which a plurality of layers constituted from toners with different low-temperature storage elastic modulus as measured in a temperature range of 30° C. or more and 50° C. or less are superposed on each other, to a medium, and that changes a fixing temperature in accordance with an order of superposition of the plurality of layers, wherein the fixing temperature for a case where one of the toners that has the highest low-temperature storage elastic modulus constitutes a layer that is the closest to the medium is higher than the fixing temperature for a case where the one of the toners that has the highest low-temperature storage elastic modulus constitutes a layer other than the layer that is the closest to the medium.

* * * * *